US005596959A

United States Patent [19]

Kenmoku et al.

[11] Patent Number: 5,596,959

[45] Date of Patent: Jan. 28, 1997

[54] SHIM FOR A TAPPET IN AN INTERNAL COMBUSTION ENGINE

[75] Inventors: Takeji Kenmoku; Akihiro Hamada; Shinichi Umino, all of Fujisawa, Japan

[73] Assignee: Fuji Oozx Inc., Japan

[21] Appl. No.: 659,302

[22] Filed: Jun. 6, 1996

Related U.S. Application Data

[63] Continuation-in-part of Ser. No. 539,324, Oct. 4, 1995, abandoned, which is a continuation-in-part of Ser. No. 386,300, Feb. 8, 1995, abandoned.

[51] Int. Cl.[6] ..... F01L 1/14

[52] U.S. Cl. ..... 123/90.33; 123/90.51; 74/569

[58] Field of Search ..... 123/90.33, 90.35, 123/90.48, 90.51, 90.52, 196 R; 74/569

[56] References Cited

U.S. PATENT DOCUMENTS

| | | | |
|---|---|---|---|
| 4,312,900 | 1/1982 | Simpson | 427/181 |
| 4,856,466 | 8/1989 | Ting et al. | 123/90.33 |
| 4,871,266 | 10/1989 | Oda | 384/42 |
| 4,872,432 | 10/1989 | Rao et al. | 123/193.4 |
| 4,909,198 | 3/1990 | Shiraya et al. | 123/90.51 |
| 5,269,268 | 2/1993 | Hara | 123/90.48 |

*Primary Examiner*—Weilun Lo
*Attorney, Agent, or Firm*—Zarley, McKee, Thomte, Voorhees, & Sease

[57] ABSTRACT

A shim for a tappet is used in a valve operating mechanism in an internal combustion engine. On the surface of the shim which a cam slidably contacts, there are provided a number of bores in which lubricating oil is put. When an oil film disappears on the surface by slidable contact with the cam, oil overflows from the bores onto the surface. By increasing oil-keeping capability on the surface of the shim, frictional resistance is reduced, thereby preventing wear in the shim and the cam. The bores may be filled with a lubricating solid such as molybdenum disulfide or plastics, such as polyethylene, silicone and Teflon®. The diameter of the bores may become larger as the bores extend away from the surface of the shim, thereby preventing the solid material from being displaced from the bores. The density of the bores on the shim surface can also be varied. The density of the bores in the central area of the shim surface can be greater than in the surrounding area.

8 Claims, 3 Drawing Sheets

SHIM FOR A TAPPET IN AN INTERNAL COMBUSTION ENGINE

CROSS-REFERENCE TO RELATED APPLICATIONS

This application is a continuation-in-part of U.S. patent application Ser. No. 08/539,324, filed Oct. 4, 1995, now abandoned, which is a continuation-in-part of Ser. No. 08/386,300 (now abandoned) filed Feb. 8, 1995.

BACKGROUND OF THE INVENTION

The present invention relates to a shim between a tappet and a cam in a valve operating mechanism for an internal combustion engine, and in particular, a shim which increases oil-keeping capability on the surface which the cam slidably contacts, thereby decreasing wear.

FIG. 3 illustrates a conventional direct-acting type valve-operating mechanism used in a DOHC engine. A tappet body 1, which comprises a cylinder closed at the upper end, is slidably inserted in a bore 2*a* of a cylinder head 2. In a circular recess 3 on the upper surface of an upper wall la of the tappet body 1, a shim 4 for adjusting a valve space is detachably engaged. A cam 5 which has a nose 5a contacts the upper surface of the shim 4, the cam 5 having a center on extension of the axis of the tappet body 1. A wear resistant tip 6 is in a press fit with the upper wall 1*a* of the tappet body 1. A shaft of the engine valve 7 is provided in the tappet body 1, and the end of the shaft contacts the lower surface of the tip 6.

A spring retainer 9 is engaged with the upper end of an engine valve 7 via a pair of cotters 8 which surround the outer circumferential surface of the valve 7, and a valve spring 10 is provided between the spring retainer 9 and a base (not shown) of the cylinder head 2. The engine valve 7 is usually energized upwards by the valve spring 10, and closes a port (not shown) of the cylinder head 2.

The shim 4 is engaged with the cam 5 which rotates with rotation of an engine, and is periodically subjected to high load, so that it is susceptible to wear.

When worn, the shim 4 increases valve space, thereby generating large mechanical noise, or decreases the lifting range of the engine valve 7, thereby decreasing an opening area of the port to involve output power reduction. To overcome these disadvantages, the shim must be made of high-strength wear-resistant material, and it is necessary to decrease wear by increasing oil-keeping capability of the surface which contacts the cam 5. However, a conventional shim has a smooth flat upper surface, thereby decreasing oil-keeping capability. Thus, supplied lubricating oil is lost from the surface of the shim for relatively short time, thereby increasing frictional resistance and causing wear in the shim and the cam.

BRIEF DESCRIPTION OF THE DRAWINGS

The features and the advantages will become clear based on the following description with respect to the drawings wherein.

SUMMARY OF THE INVENTION

Figure 1:
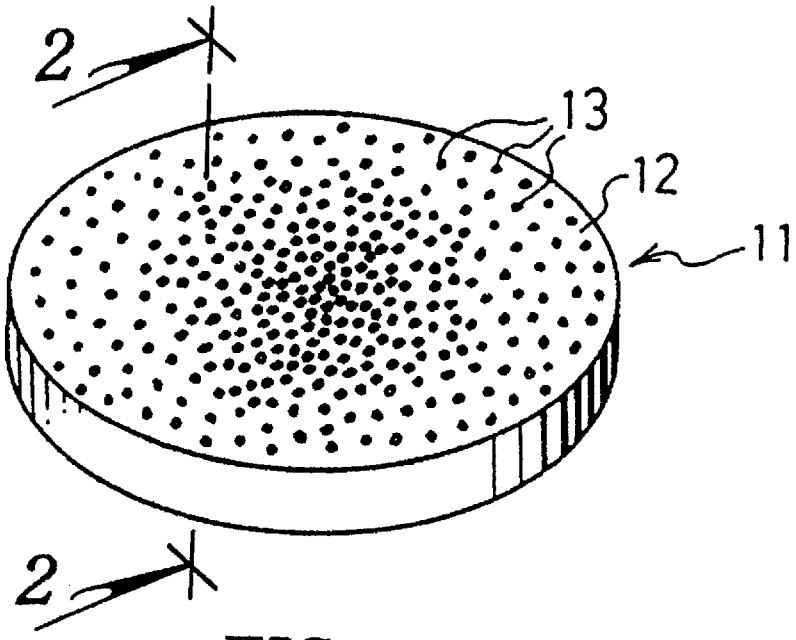
FIG. 1 is a perspective view of one embodiment of a shim according to the present invention.
Figure 2:
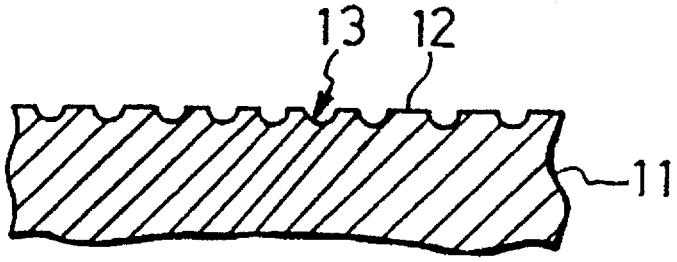
FIG. 2 is a sectional view taken along line 2—2 in FIG. 1.
Figure 3:
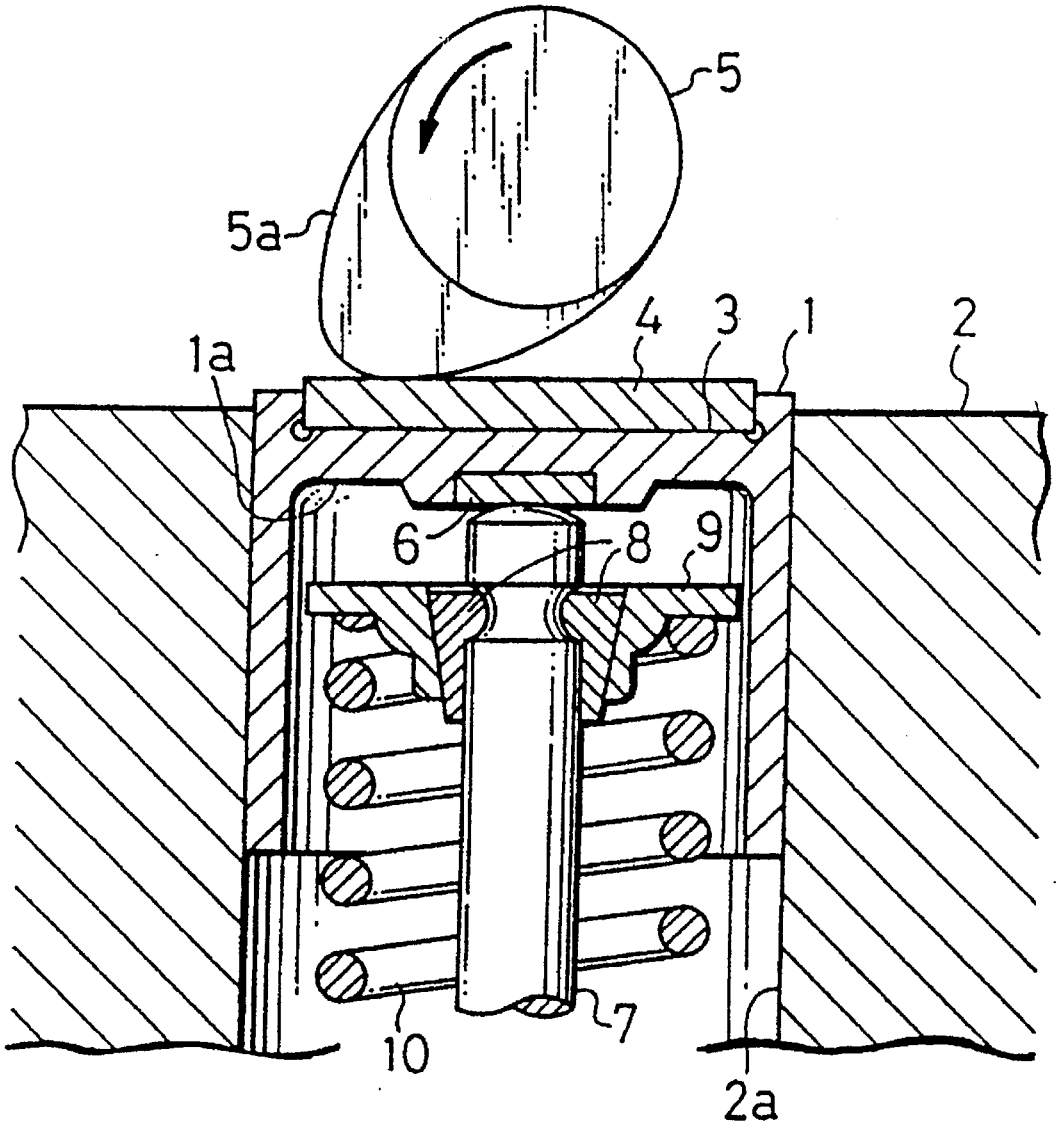
FIG. 3 is a sectional view of a known valve-operating mechanism in an internal combustion engine.

To overcome the disadvantages, it is an object of the present invention to provide a shim for a tappet in an internal combustion engine wherein wear is decreased by increasing oil-keeping capability of the surface of the shim which contacts the cam.

According to the present invention, a shim is provided on the upper wall of a tappet in a valve operating mechanism of an internal combustion engine, the shim contacting a cam which rotates with an engine, wherein there are provided a number of bores on the surface which the cam slidably contacts.

An opening area of the bore may be 0.1 to 50000 $\mu m^2$. The bores may be arranged in varying density on the surface of the shim which the cam slidably contacts. There are provided a number of bores on the surface of the shim which the cam slidably contacts, so that supplied lubricating oil is kept in the bores, thereby decreasing frictional resistance of the shim and the cam to prevent wear in the shim and the cam. Thus, the engine valve is more precisely and durably operated.

DETAILED DESCRIPTION OF PREFERRED EMBODIMENTS

A shim 11 is formed as a disc of material having high strength and high wear resistance similar to a conventional shim for a valve-operating mechanism. There are formed a number of minute bores 13 on the upper surface of the shim 11 which a cam 5 slidably contacts. The bore 13 may be various forms other than a circle. The area of an upper opening of the bore 13 may be 0.1 to 50000 $\mu m^2$, preferably 0.1 to 1250 $\mu m^2$. Areas less than 0.1 $\mu m^2$ do not provide suitable oil maintenance, while areas more than 50000 $\mu m^2$ significantly decrease the strength of the shim 11. The bores 13 are provided on the whole area which the cam 5 contacts except the circumferential portion of the shim 11. The density of bores 13 (per surface area) in the central area of the shim surface is greater than in the surrounding area.

When there are provided a number of bores 13 on the upper surface 12 of the shim 11, lubricating oil is kept in the bores 13, and a certain amount of lubricating oil is stored in the bores 13 even if the cam 5 slides on the upper surface 12 to displace the oil film on the upper surface 12. The lubricating oil in the bores 13 overflows onto the upper surface 12 to form an oil film. A number of bores 13 are formed on the upper surface 12 to provide oil-keeping capability, thereby reducing frictional resistance between the shim 11 and the cam 5 to prevent wear of the shim 11 and the cam 5.

Figure 4:
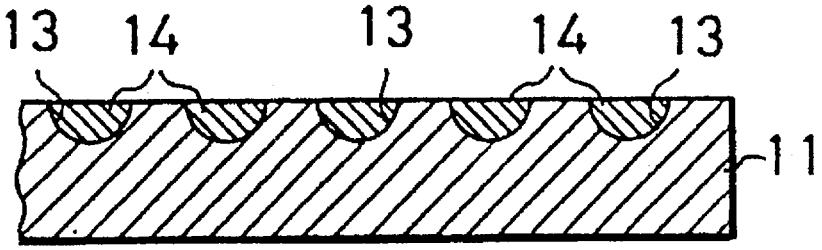
FIG. 4 is a sectional view similar to FIG. 2, but showing an alternative embodiment wherein lubricating solid material is provided in the bores.

As shown in FIG. 4, the bores 13 can be formed as hemispheres, and can also be filled with a lubricating solid material 14. The material 14 may be one of molybdenum disulfide, plastics such as polyethylene, silicone and Teflon®. The material 14 is filled in the bores 13 of the shim 11 so that the upper surface of the material may be substantially as high as the surface of the shim, or slightly higher than the surface of the shim 11.

When the shim 4 is pressed by the cam 5, the lubricating solid material 14 filled in the bores 13 acts as lubricant for decreasing frictional resistance, and is dispersed on the surface of the shim 11 other than the bores 13. Thus, frictional resistance between the cam 5 and the shim 11 is reduced, thereby preventing or significantly reducing wear of the shim 11 and the cam 5.

Figure 5:
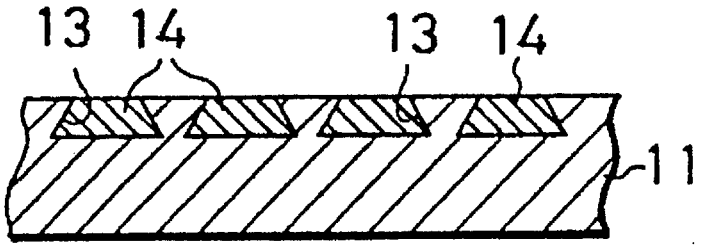
FIG. 5 is a sectional view similar to FIG. 4, but showing a further alternative embodiment wherein the diameter of the bores is larger remote from the contact surface.

As shown in FIG. 5, the bores 13 may also be formed such that the diameters increase as the bores 13 extend downward farther from the surface of the shim 11, thereby impeding the escape of the solid material 14 from the bores 13.

The above merely relates to preferred embodiments of the invention. Any modifications and changes may be made by person skilled in the art without departing from the scope of claims.

What is claimed is:

1. A shim for a tappet in an internal combustion engine having a cam which rotates with the engine, comprising;

a shim member mounted on the tappet and having a contact surface thereon for slidably contacting the cam, the contact surface having a central area and a second area surrounding the central area;

the shim having a plurality of bores on the contact surface, the density of the bores in the central area being higher than the density of the bores in the surrounding second area.

2. A shim as defined in claim 1 wherein an opening area of the bore at the contact surface of the shim is 0.1 to 50000 $\mu m^2$.

3. A shim as defined in claim 1 wherein lubricating solid material is filled in at least some of the bores.

4. A shim as defined in claim 3 wherein the lubricating solid material is filled in said bores so that an upper surface of the solid material is substantially as high as the contact surface of the shim.

5. A shim as defined in claim 3 wherein the lubricating solid material comprises molybdenum disulfide.

6. A shim as defined in claim 3 wherein the lubricating solid material comprises polyethylene.

7. A shim as defined in claim 1 wherein at least some of said bores are formed as hemispheres.

8. A shim as defined in claim 3 wherein at least some of said bores have a first diameter at the contact surface and a second diameter remote from the contact surface of the shim, the second diameter being larger than the first diameter, thereby impeding the solid material from escaping from the bores.

* * * * *